United States Patent [19]

Seyle

[11] Patent Number: 4,501,517

[45] Date of Patent: Feb. 26, 1985

[54] SELF PROPELLED TRENCH SHIELD

[76] Inventor: Robert A. Seyle, 20230 F.M. 1488, Magnolia, Tex. 77355

[21] Appl. No.: 418,660

[22] Filed: Sep. 16, 1982

[51] Int. Cl.[3] ..... B66F 1/04; E02D 5/00; E02F 3/24; E21D 21/00

[52] U.S. Cl. ..... 405/283; 405/259; 37/189; 254/108

[58] Field of Search ..... 405/141, 146, 259, 262, 405/272, 282, 283; 37/81, 82, 189; 175/94, 118; 299/31; 173/32, 33, 142; 254/108

[56] References Cited

U.S. PATENT DOCUMENTS

| | | | |
|---|---|---|---|
| 3,089,310 | 5/1963 | Torti | 405/283 |
| 3,715,889 | 2/1973 | Bixler et al. | 405/283 |
| 3,830,315 | 8/1974 | Love | 405/259 X |
| 3,870,279 | 3/1975 | Century | 299/31 X |
| 3,903,624 | 9/1975 | Holl | 405/283 X |
| 3,967,454 | 7/1976 | Barnes | 405/282 |
| 3,995,565 | 12/1976 | Kersey | 405/282 X |
| 3,999,391 | 12/1976 | Meredith | 405/262 X |
| 4,091,626 | 5/1978 | Thompson | 405/283 |
| 4,212,450 | 7/1980 | Lambert | 254/108 |
| 4,279,548 | 7/1981 | Ramey | 405/282 X |

*Primary Examiner*—Cornelius J. Husar
*Assistant Examiner*—Nancy J. Stodola
*Attorney, Agent, or Firm*—David Ostfeld

[57] ABSTRACT

An apparatus and a method for excavating and pile reinforcing trenches is disclosed. A box-like central structure serves as a frame within which excavation by customary means, e.g., externally positioned back hoes, takes place. The outside walls of said central structure form temporary trench walls supporting the surrounding dirt. The inside walls of said central structure form a rear section, behind which flat piling is driven in before the entire unit advances. Advancement is carried out by means of longitudinal anchoring to the earth in the direction of travel of the apparatus and a longitudinal propulsion mechanism riding on the box frame and alternatively drilling and pushing periodically. In addition, end aligned shafts with cutting members are disposed within the front edges of the box frame walls to facilitate tunneling forward during the propulsion cycle.

10 Claims, 12 Drawing Figures

2
8
66
12
9
2
16
10
27
7
42
39
14
62
64
74
23
25
60
6
35
21
4
37
70
58
33
54
72
32
56
2
68
34
52

42
41
39
26
66
2
12
6
74
58
27
32
30
18
28
20
22
36
40
38
35
23
62
54
70
29
34
24
4

188
177
178
172
70
182
176
175
179

180
184
182
186
188

SELF PROPELLED TRENCH SHIELD

TECHNICAL FIELD

This invention relates to the excavation of ditches or trenches and to their reinforcement by piles or other wall forming means.

BACKGROUND ART

In most trenching operations in soft soil, the cross-section of the excavation area turns out to be of generally trapezoidal shape. Although the hoe or similar excavation means will initially remove only a rectangular section of soil, almost invariably the upper edges of the trench so dug will then cave in and leave the trapezoidal form mentioned above. A wider horizontal section of soil is therefore customarily removed from the top than is required by the dimensions of the bottom of the trench. The same phenomenon necessitates the use of substantial areas outside and alongside the trench for positioning pile driving means in order to reinforce the walls of the excavated ditch. Because such piling is usually driven in perpendicular to the bottom of the trench, the top section of each pile is freestanding and not supported by the surrounding soil. It must therefore be driven in a substantial distance beyond the bottom of the trench in order to assure the required structural rigidity for the sidewalls thus formed.

There are many situations, however, where the room for operating trenching and piling equipment is severely restricted, both horizontally and, possibly, even vertically, be it because of problems of access and right-of-way or because of geological conditions and where control of grade and line is important. In such circumstances the desirability of digging and reinforcing trenches with truly vertical sidewalls and with a minimum of lateral surface access requirements has long been recognized by the industry. See, for example, U.S. Pat. No. 4,279,548, entitled "Hydraulic Propulsion Unit", issued July 21, 1981, to Raymond W. Ramey.

It is the object of the present invention to satisfy this long felt need and the need for speed of excavation and uniformity of trench and operation with the help of a hydraulic, self-advancing excavation unit which requires the removal of, and access to, no more soil than is actually defined by the dimension of the trench while using a propulsion system anchored in front of the unit to produce a trenching machine quality, uniform trench in conjunction with standard trenching tools, such as a back hoe.

DISCLOSURE OF INVENTION

The present invention provides a trenching shield device for use in preparing for the excavation of ditches and for subsequently reinforcing the sidewalls of the ditches. The trenching shield is used in conjunction with a back hoe or similar excavation mechanism and in conjunction with a pile driving apparatus for inserting piles along the walls of the ditch. The trenching device of the present invention comprises an excavation box having metal sidewalls connected by spacer plates with cutting means mounted on the front edges of these sidewalls, and propulsion means mounted on the box for advancing the excavation box in conjunction with anchoring means in front of the box. The anchoring means, when implanted in the earth in front of the box, provides the support for propelling the excavation box forward into the facing earth through the expansion of the hydraulic propulsion means combined with the action of the cutting means disposed along the front edges of the sidewalls. Initially, however, slightly more than the thickness of the sidewalls is cut by the cutting means as the box advances. The bulk of the soil between the sidewalls is then scooped up by customary digging means positioned outside or in front of the submerged excavation box. Pilings are driven in as the box advances right behind; i.e.: inside of, the rear portion of the sidewalls of the excavation box. Advancing the box is facilitated through a set of beams along which alternatingly the propulsion mechanism can slide relative to the box and remain fixed relative to the box. Accordingly, the propulsion means can force the box to slide forward, pushed by expanding the propulsion means, with respect to the anchoring means and the anchoring means can be forced forward with respect to the stationary excavation box as part of contraction cycle of the propulsion means. This invention is described to some extent in the "Abstract of the Invention" which is attached hereto and incorporated herewith by reference.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DESCRIPTION OF THE PREFERRED EMBODIMENT

Figure 1:
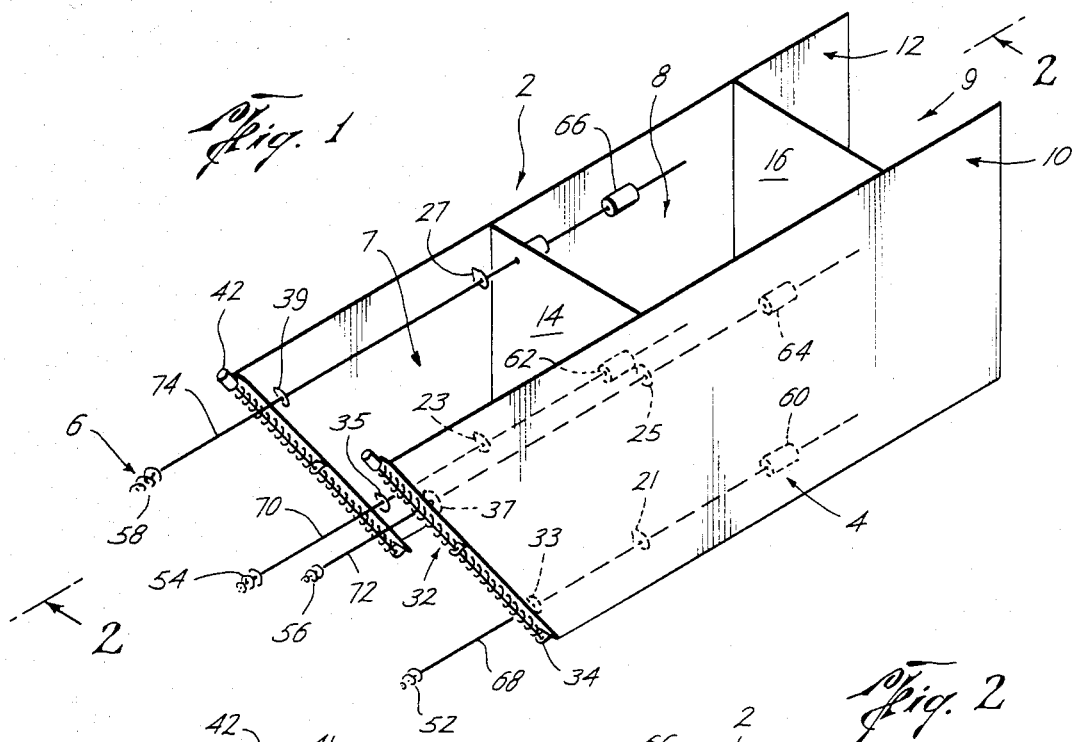
FIG. 1 is a perspective view of the preferred embodiment of the self propelled trench shield of the present invention.
Figure 2:
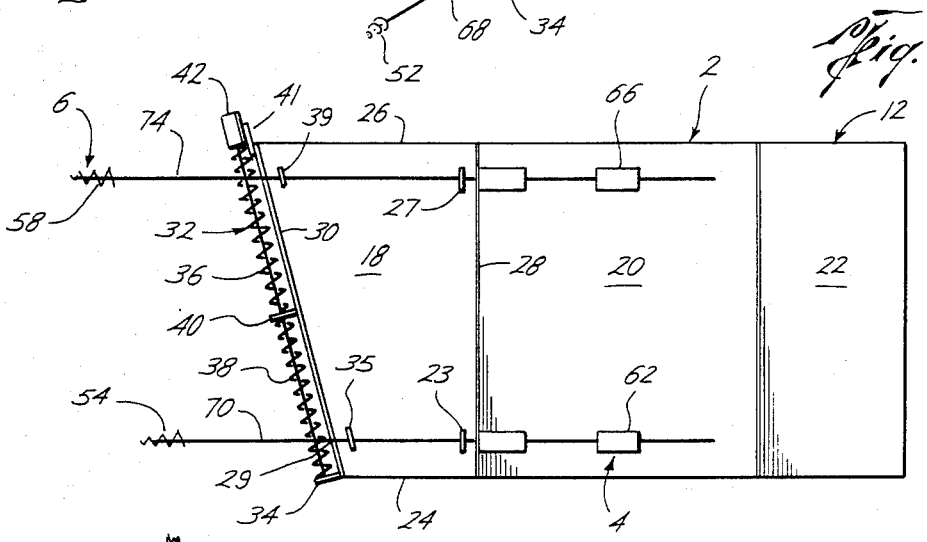
FIG. 2 is a side cross-sectional view of the preferred embodiment of the trench shield of the present invention taken along section line 2—2 of FIG. 1.
Figure 9:
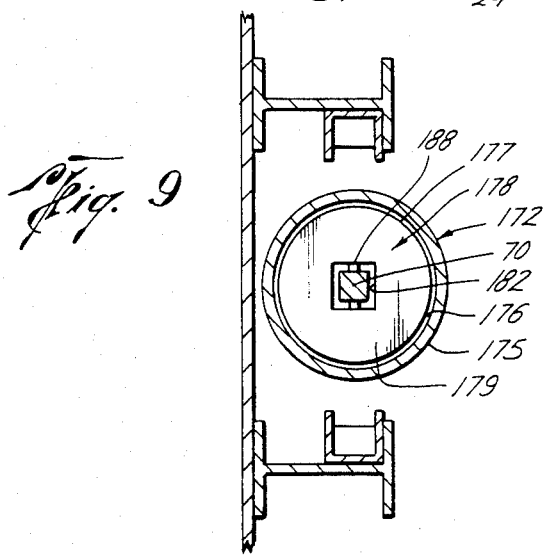
FIG. 9 is a cross-sectional view olf the anchor and propulsion mechanism taken along section line 9—9 of FIG. 3.
Figure 10:
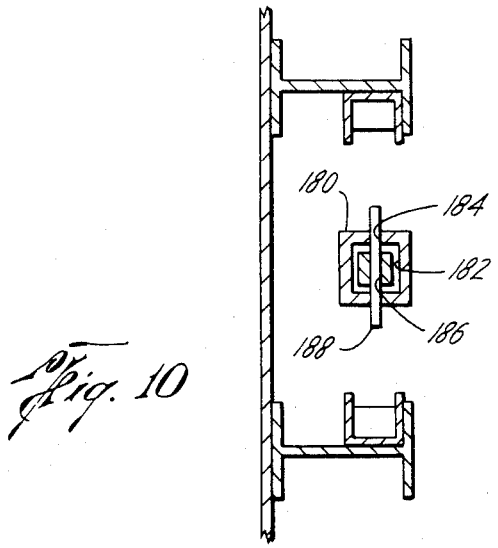
FIG. 10 is a cross-sectional view of the anchor and propulsion mechanism taken along section line 10—10 of FIG. 3.

Referring to FIGS. 1 and 2, there is shown the self propelled trench shield of the present invention. The shield can be seen to comprise three main components: an excavation box 2, propulsion means 4, and anchor means 6.

The excavation box 2 includes side plates 10, 12 separated by front and rear spacer plates 14, 16. The side plates 10, 12 and front and rear spacer plates 14, 16 divide the excavation box 2 into three main sections: a front section 7, within which cutting or excavation means are either located or applied, a mid section 8 wherein the control means, power plants and majority of the propulsion means 4 is located, and a rear section 9 within which piling reinforcement of the excavated trench takes place. Accordingly, each of plates 10, 12 has three sections, a front section 18, and mid section 20, and a rear section 22.

Front section 18 has a cross-sectional shape of that of a trapezoid with sides 24, 26, 28, 30. Sides 24 and 26 are parallel to each other, and side 28 is perpendicular to sides 24, 26. Side 30 has a slope, preferably, of ½: 1 to minimize sluffing of the dirt encountered by side 30 during the trenching operation; i.e.: to provide the best angle of repose for digging face stability.

Accordingly, the front section 7 is bounded by front spacer plate 14 and front sections 18 of side plates 10, 12. The cantilever front sections 18 provide an unobstructed access for a back hoe (not shown) to perform excavation work. Front sections 18 have a depth designed to penetrate the digging face to prevent lateral caving of the trench and may be approximately eleven feet in depth at the top and four feet in depth at the bottom to permit the entry of the bucket for excavation.

An earth digging auger 32 is attached to and runs parallel with each side 30. Each auger 22 has two helical sections 36, 38 connected by an intermediate bearing 40 at one end of each of helical members 36, 38. Auger 32 is attached to side 30 at the lower end of helical section 38 by thrust or carrier bearing 34. The other end of helical section 36 is connected to hydraulic motor/bearing 42 attached to side 26 by a plate 41 through welding or other suitable means. Hydraulic motor/bearing 42 is driven by a hydraulic power source (not shown). The helical teeth of sections 36, 38 of the auger 32 are oversized to be several inches wider than the wall thickness of front section 18, such as thirteen inches in size for a wall thickness of twelve inches, so as to cut a way for the wall. This permits the front section 18 to be thrust into the digging face.

Figure 11:
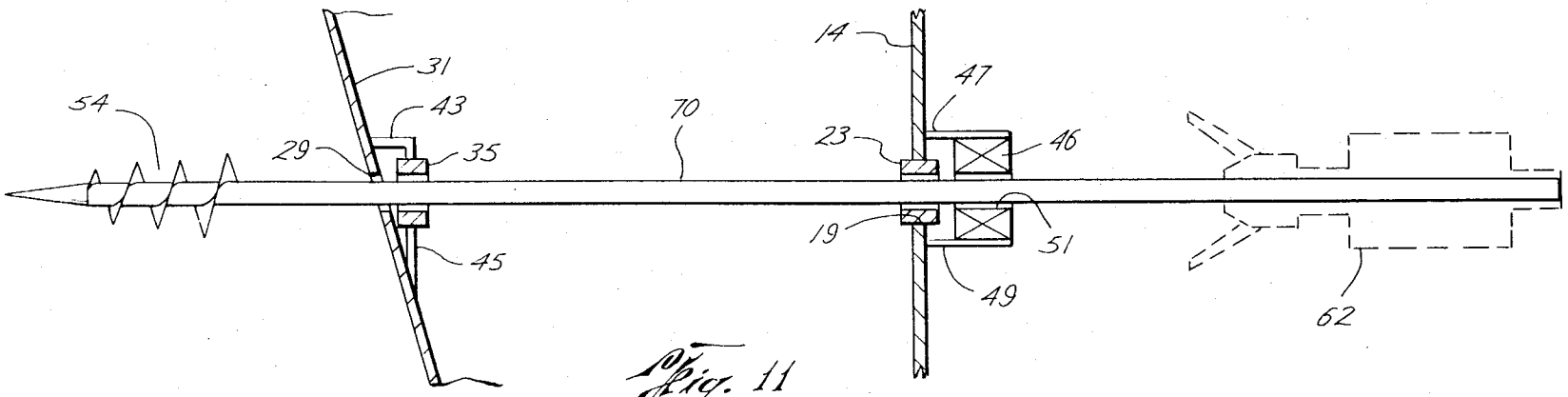
FIG. 11 is a diagrammatic, partial, side cross-sectional view of the anchor and propulsion mechanism showing a portion of the preferred embodiment of the propulsion mechanism.
Figure 12:
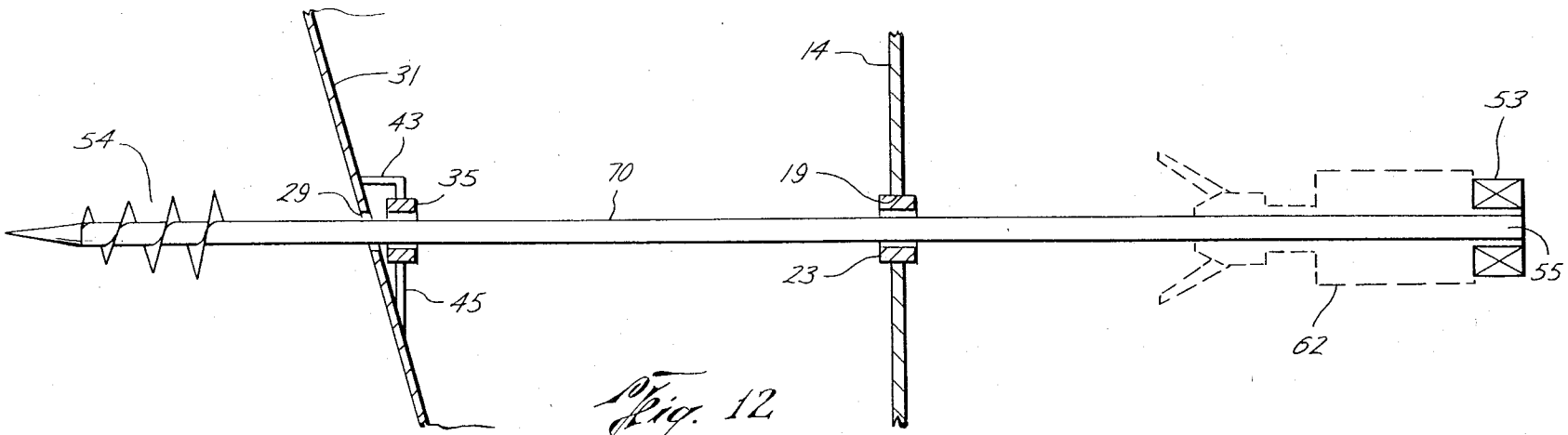
FIG. 12 is a diagrammatic, partial, side cross-sectional view of the anchor and propulsion mechanism showing a portion of another embodiment of the propulsion mechanism.

The mid section 8 is bounded by front plate 14, rear plate 16, and mid sections 20 of side plates 10, 12. Referring to FIGS. 1, 2, 11, 12, plate 14 includes four openings, such as opening 19 of FIGS. 11, 12, in which are mounted bearings 21, 23, 25, and 27. The openings, such as opening 19 in FIGS. 11, 12, are aligned with openings, such as opening 29 in FIGS. 11, 12, in inwardly facing lips or faces, such as lip or face 31 in FIGS. 11, 12. The lips are mounted by welding or bending or other suitable means on sides 30, such as being a face of a channel section. A second set of bearings 33, 35, 37, 39 are mounted behind each of these second openings, such as opening 29 in FIGS. 11, 12, by welding to two plates welded to the lips, such as plates 43, 45 in FIGS. 11, 12.

The control portion (not shown) for the anchor means 6, the propulsion means 4, the motor/bearings 42 and other hydraulic mechanisms are located in mid section 8. Also located in mid section 8 are the hydraulic pumps and diesel motor that drives these mechanisms.

The rear section 8 is bounded by rear spacer plate 16 and rear sections 22 of side plates 10, 12. Sections 22 of plates 10, 12 are adapted to receive along themselves flat piles customarily used in the art which are driven into the soil on the inner sides of sections 22 by any of the usual means known in the art, such as pile driving or vibrating, while the excavation box 2 of the present invention advances. It is, therefore, not necessary to interrupt the excavation process and to remove the excavation box 2 in order to insert piles along the walls of the trench.

In the preferred embodiment, plates 10, 12, 14, 16 are constructed of steel plate of sufficient thickness to withstand the pressure from the adjacent earth and ocassional battering from the backhoe and pile driving mechanisms.

The anchor means 6 includes four anchor helixes 52, 54, 56, 58 extending forward of section 7. These helixes are commercially available, such as from Anchoring International, for drilling laterally into dirt. Each helix 52, 54, 56, 58 has a rear bearing surface which prevents easy extraction by pulling out of the dirt.

The propulsion means 4 includes drive sections 60, 62, 64, 66 for anchor helixes 52, 54, 56, 58, and shaft sections or kellys 68, 70, 72, 74 attached thereto, respectively, and to anchor helixes 52, 54, 56, 58, respectively. A portion of each kelly 68, 70, 72, 74 extends beyond section 7 and connects to helixes 52, 54, 56, 58, respectively, by bolts, such as bolts 76, 78 for helix 54 and kelly 70 as shown in FIG. 3.

Figures 3, 4, 5, 6, 7, 8:
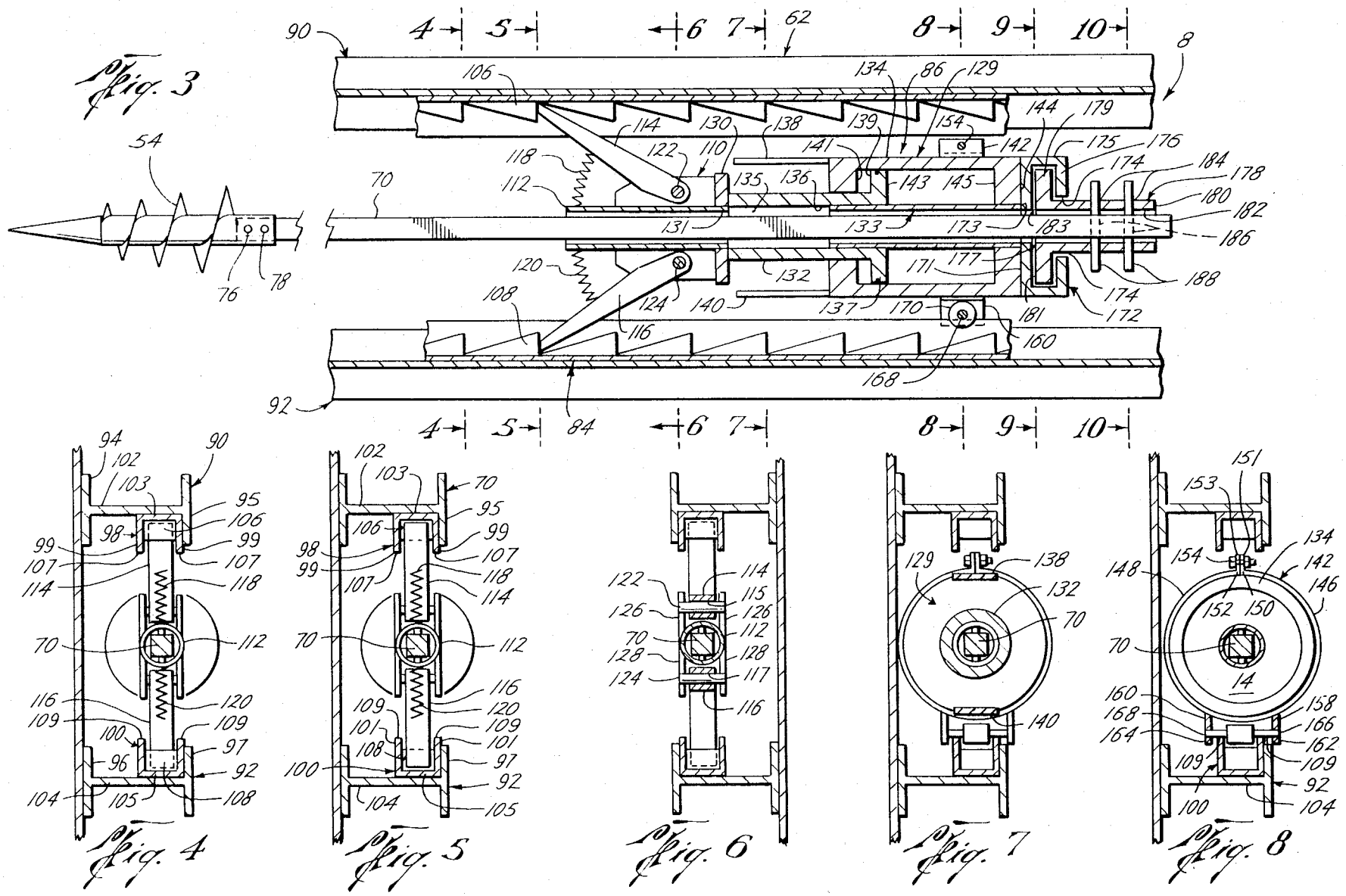
FIG. 3 is a cross-sectional view of the preferred embodiment of one of the anchor and propulsion mechansim of the preferred embodiment of the trench shield of the present invention.
FIG. 4 is a cross-sectional view of the anchor and propulsion mechanism taken along section line 4—4 of FIG. 3.
FIG. 5 is a cross-sectional view of the anchor and propulsion mechanism taken along section line 5—5 of FIG. 3.
FIG. 6 is a cross-sectional view of the anchor and propulsion mechanism taken along section line 6—6 of FIG. 3.
FIG. 7 is a cross-sectional view of the anchor and propulsion mechansim taken along section line 7—7 of FIG. 3.
FIG. 8 is a cross-sectional view of the anchor and propulsion mechanism taken along section line 8—8 of FIG. 3.

Referring to FIGS. 3, 11, 12, a typical anchor helix 54, drive section 62 and kelly 70 are shown. FIG. 3 best illustrates the anchor helix 54, drive section 62 and kelly 70 required for the continuous mode of operation of the propulsion means 4 of the present invention. In the preferred embodiment of the present invention, the anchor helixes, drive sections and kellys are symmetrical in structure and function. Therefore, only one such shall be described in detail, it being understood that, unless expressly noted otherwise, there exist a corresponding counterpart to every part referred to in the following description.

As shown in FIGS. 3, 11, 12, kelly 70 extends from anchor helix 54 through drive section 62 and into the interior of mid section 8. Kelly 70 may be rotated, preferably, by an hydraulic motor 46 (FIG. 11) mounted by plates 47, 49 to plate 14. Kelly 70 would be coaxial with the interior 51 axis of the motor 46 and would be rotated about its axis. Motor 46 could be of a hollow core type as manufactured by Rineer Hydraulics, Inc. It should be noted that this method is preferable because all motors could be initially mounted as an integral part of the drive section 62 and all helixes could be rotated simultaneously. Alternatively, as shown in FIG. 12, a motor 53 may be mounted behind drive section 62, such as by a crane (not shown) and attached to the end 55 (FIG. 12) of the kelly 70. In this alternate embodiment, the kelly 70 could have the motor 53 mounted on it selectively, have it removed, and have the motor 53 used with other helixes. Motor 53 could also be of the same type as motor 42. It should be noted that the motors 46, 53 are selected to yield low speed rotation under normal circumstances.

The remainder of drive sections 60, 62, 64, 66 required for the continuous mode of operation of the present invention are best illustrated in FIG. 3 by drive section 62. Drive section 62 includes support structure 84 and propulsion structure 86 which support kelly 70 and anchor helix 54.

Support structure 84 includes spaced apart, parallel mounted wide flange beams 90, 92. Beams 90, 92 include outer flanges 94, 96. Beams 90, 92 are mounted by attaching flanges 94, 96, respectively, flushly against section 20 by welding or other suitable means. Oppositely disposed U-structures 98, 100 are mounted on the webs 102, 104, respectively, of beams 90, 92, respectively. U-structures 98, 100 include sides 99, 101, respectively, and bottoms 103, 105, respectively. Bottoms 103, 105 are connected by welding or other means to webs 102, 104. Sides 99, 101 are connected by welding or other means to flanges 95, 97, respectively. Structures 98, 100 open to face each other with oppositely disposed tips 107, 109, respectively, of sides 99, 101. The interior of each U-structure 98, 100 houses teeth 106, 108 which are saw tooth in shape, formed by cutting or other suitable means, and attached to the U-shaped structures 98, 100, respectively, by welding or other suitable means.

The propulsion structure 86 includes rachet assembly 110 at its leading edge mounted about a cylinder 112. Rachet assembly 110 includes dogs 114, 116 connected near their outer ends to springs 118, 120, respectively. The other end of springs 118, 120 are connected to cylinder 112. These connections may be by welding or other suitable means. The inner end of dogs 114, 116 have passageways 115, 117 formed laterally therethrough by drilling or other means. Pins 122, 124 are rotatably received in passageways 115, 117, respectively. Pins 122, 124 are also rotatably mounted on ears 126, 128, respectively, which are welded to cylinder 112.

Ears 126, 128 also held together by back plate 130 which has a hollow central opening 131 to fit over cylinder 112. Back plate 130 is welded to the inner end of ears 126, 128. The springs 118, 120 are designed to force dogs 114, 116, respectively, outwardly away from cylinder 112.

Plate 130 is also connected to a hollow piston 132 of a hollow core jack 129, such as that obtainable from Enerpac, a division of Applied Power, Inc. Co. Piston 132 includes hollow cylindrical center 135 bounded by the cylindrical inner wall 136 of piston 132 and is reciprocally mounted about receiving cylinder 133 in center 135. Piston 132 is also reciprocally mounted in hydraulic cylinder 134. Piston 132 further has a enlarged, hollow flange 137 having outer side 139 facing inwardly facing side 141 of cylinder 133 and inner side 143 facing outwardly facing side 145 of cylinder 133. Jack 129 is double acting and is connected (by means not shown) to a suitable source of driving media, such as a hydraulic fluid pump.

Cylinder 134 includes retracting arms 139, 140 at its outwardly facing end. Arms 138, 140 are disposed on opposite ends of cylinder 134 and are disposed in the same longitudinal orientation as dogs 114, 116, respectively. A split strap mechanism 142 circumferentially surrounds cylinder 134 near its inwardly facing end 144. Strap 142 is sized to slip over cylinder 134. Strap 142 includes strap sections 146, 148, having upper flanges 150, 152, respectively. Flanges 150, 152 have holes 151, 153, respectively laterally therethrough and are pinned by bolt 154 extending through holes 151, 153. Ears 158, 160 extend longitudinally from the lower portion of straps 146, 148, respectively. Ears 158, 160 have lateral openings 162, 164, respectively, through their lower ends. Metal rollers 166, 168 are rotatably mounted in and have their outer ends extend through openings 162, 164, respectively. Rollers 166, 168 are rotatably connected at their inner ends to liner/spacer 170 which extends into the upper space of U-structure 100.

Cylinder 133 is coaxial with and of larger diameter than cylinder 112.

The bottom 171 of a container ring 172 is mounted, by welding or other suitable means, to end 144 of cylinder 134. Container ring 172 includes outer face opening 173 which is circular in shape, coaxial with cylinder 133, and of approximately the same diameter as the inner diameter of cylinder 133. Opening 173 is formed by cutting or other suitable means. Ring 172 further includes cylindrical sidewall 175 and an annular opening 174 at its inwardly facing end bounded by circular flange 176. Flange 176, base 171, and sides 175 form a cylindrical space 177 therebetween .

The enlarged section 179 of a swivel 178 is mounted in space 177. Swivel 178 further includes a narrow section 180 extending longitudinally inward from enlarged section 179 through opening 174. Enlarged section 179 is rotatably mounted in chamber 177 and, when rotating, normally has its outwardly facing surface 181 abutting the inwardly facing surface of base 173 with a grease coating (not shown) therebetween. Swivel 178 further has hollow center 182 coaxial with cylinder 133 surrounding kelly 70. Section 180 and kelly 70 have juxtaposed openings 184, 186, respectively, therethrough which are coaxial. Pins 188 extend through such openings and connect cylindrical section 180 to kelly 70. Accordingly, kelly 70 is pinned to the helix 54 with bolts 76, 78 and extends through cylinder 112, cylinder 133, opening 173, opening 182 and past the end of section 178 and is also pinned to section 180 with pins 188.

In operation, a pit is first excavated to line and grade to begin the trench. The trench shield box 2 is then placed and oriented in the pit to line and grade. Piston 132 is then forced by hydraulic fluid flowing through openings in the outer ends (not shown) between faces 139, 141 in cylinder 134 until flange face 143 abuts face 145. As piston flange face 143 approaches cylinder face 145, dogs 114, 116 come into sliding contact with retraction arms 138, 140, respectively, which force dogs 114, 116 to rotate about pins 122, 124, respectively, toward cylinder 112. After dogs 114, 116 are retracted, section 62 is forced forward and kelly 70 is rotated slowly by motor 46 or motor 53. Anchor helix 54 is thereby rotated and driven into the earth in front of the box 2.

After the anchor helix 54 is augered into the digging face of the earth, hydraulic fluid is forced into the cylinder (by means not shown) between faces 143, 145, thereby forcing flange 137 away from face 145. Dogs 114, 116 are then forced from under arms 138, 140 and are extended by springs 118, 120, respectively, so that they engage teeth 106, 108, respectively. Further force applied between faces 143, 145 push the entire trencher box 2 forward along kelly 70 towards the digging face of the earth in which helix 54 is embedded. Motors 42 are activated so that the auger members 36, 38 will bite into the digging surface of the earth. At the end of each stroke of piston 132, it is retracted by hydraulic fluid forced in between faces 139, 141, thereby forcing flange face 143 towards cylinder face 145. Dogs 114, 116 are thereby pulled inwardly and ride up teeth 106 108, and fall into the next tooth valley. After the dogs 114, 116 have fallen into the next valleys, the hydraulic pressure is reversed, forcing flange 137 away from surface 145 to further cause the trencher box 2 to move forward. After solid contact has been made between the earth and the forward edges of the trencher, excavating of the space 7 can begin by a backhoe or other similar mechanism with augers graders 36, 38 aiding in the operation. As the backhoe completes excavation of a portion of the dirt, the piston 132 is again activated to force the trencher box 2 forward closer to the anchor helix 54. After several of these operations, either the anchor helix 54 will no longer have sufficient dirt to support it or the dogs 114, 116 will have reached the end of the teeth 106, 108. In either case, the dogs 114, 116 are again pulled under the retracting arms 138 and 140, respectively, and the drilling operation is commenced again.

As the trencher box 2 moves forward, shoring by either steel sheet piling or wood is installed in the trailing end 9 against the sides 22. Therefore, as the trencher box 2 moves forward beyond the shoring, the shoring is in place to prevent collapse of the earth in the trench.

Each of the hydraulic jacks 129 is, for example, of the 150 on capacity which may be obtained from commercial sources such as Enerpac, a division of Applied Power, Inc. In addition, the hydraulic power may be supplied by any suitable source, such as a 3208 Caterpillar engine driving three hydraulic pumps. The power module is usually attached to the top of the mid section 8 located so as to be above the trench to provide good operator visibility and to keep exhaust fumes out of the trench. An operator station complete with valve control and pressure gauges would be provided on the power module.

Although the system described in detail above is most satisfactory and preferred, many variations in structure and methods are possible. Examples of these possible changes and variations have been given above in the specification.

Because of many varying and different embodiments may be made within the scope of the inventive concept herein taught and because modifications may be made in accordance with the descriptive requirements of the law, it should be understood that the details herein are to be interpreted as illustrative and not in a limiting sense.

What is claimed as invention is:

1. A trench shield for use in excavating an open trench in the earth, comprising:

an excavation box having sides;

anchor means for digging into the earth, said anchor means including resistant means for resisting the extraction of said anchor means from the earth by pulling;

at least one kelly, said kelly being connected to said anchor means; and propulsion means connected to said kelly behind said anchor means and connected to said box for alternately forcing said anchor means into the earth and forcing said box to travel along said kelly toward said anchor means, said propulsion means including-rotating means for engaging said kelly and rotating said kelly while forcing said kelly toward the earth in front of said helix, drive means slidably mounted on said kelly for engaging said box and forcing said box along said kelly toward said anchor means.

2. A trench shield for use in excavating an open trench in the earth, comprising:

an excavation box having sides;

anchor means for digging into the earth, said anchor means including resistant means for resisting the extraction of said anchor means from the earth by pulling;

at least one kelly, said kelly being connected to said anchor means; and propulsion means connected to said kelly behind said anchor means and connected to said box for alternately forcing said anchor means into the earth and forcing said box to travel along said kelly toward said anchor means, said propulsion means including-rotating means for engaging said kelly and rotating said kelly while forcing said kelly toward the earth in front of said helix, drive means slidably mounted on said kelly for engaging said box and forcing said box along said kelly toward said anchor means;

said box includes teeth along its sides; said drive means includes-rachet arms slidingly mounted along said kelly for engaging said teeth, retraction means for forcing said rachet arms away from said teeth, reciprocating means slidingly mounted along said kelly for alternately forcing said rachet means in engagement with said teeth and said retraction means.

3. The shield of claim 2 wherein:

said propulsion means includes a plurality of anchor helixes and a corresponding plurality of rods, each of said rods being connected to the back of one of said helixes;

there is a plurality of kellys, each of said kellys being connected to one of said rods;

there is a plurality of teeth sets mounted along the side of said box, each of said sets aligned with one of said kellys;

there is a plurality of rachet means corresponding to the number of kellys, each of said rachet means being slidingly mounted along one of said kellys;

there is a plurality of retraction means corresponding to the number of said rachet means, each of said retraction means being mounted in alignment with one of said rachet means;

there is a plurality of reciprocating means corresponding to the number of said rachet means, each said rachet means being mounted on one of said reciprocating means.

4. A trench shield for use in excavating an open trench in the earth, comprising:

an excavation box, said box having a plurality of spaced apart sets of teeth mounted on the sides of said box;

a plurality of anchor helixes;

a plurality of kellys, each of said kellys corresponding to and being connected to one of said anchor helixes;

rotating motor means adapted to be mounted on said kellys for rotating said kellys and for forcing said kellys toward the earth in front of said helixes;

a plurality of rachet assemblies, each rachet assembly corresponding to and slidingly mounted on one of said kellys, each of said rachet assemblies having a plurality of dogs sized to engage a set of said teeth;

a plurality of sets of retracting arms corresponding to said kellys; and a plurality of hollow-core jacks corresponding to and slidingly mounted on said kellys, each of said jacks having a piston and a cylinder, one set of said retracting arms being mounted on and projecting outwardly from each of said cylinders and aligned with said dogs, and each of said pistons being connected to the corresponding one of said rachet assemblies.

5. The shield of claim 4 wherein there is further included means for rotating said kellys relative to the corresponding one of said jacks and said rachet assemblies.

6. The shield of claim 4 wherein said box includes two sides and two spaced apart partition plates connected to said sides and said jacks are mounted between said plates.

7. The shield of any of claims 4-6 wherein the leading edges of said box include auger means for cutting into the earth.

8. A method for forming a trench in the earth using an excavation box which has been placed in an excavation to line and grade of the trench to be formed and aligned with the direction of the trench to be formed, comprising the cyclical steps of:

A. Drilling anchor members into the soil ahead of the box a sufficient distance to anchor the anchor members into the soil;

B. Engaging a propulsion system to the box, the propulsion system being mounted on the box so as to move relative to the anchor members;

C. Activating the propulsion system to force the box toward the anchor mechanism; and D. Disengaging the propulsion system from the box.

9. The method of claim 8 wherein step A including the step of carrying the propulsion system with the anchor members during the drilling.

10. The method of claim 9 wherein step B includes the step of excavating a portion of the trench in front of the box during said movement of the box relative to the anchor means.

* * * * *